US006510230B2

(12) United States Patent
Marx

(10) Patent No.: US 6,510,230 B2
(45) Date of Patent: Jan. 21, 2003

(54) SUPPORT DEVICE FOR A BEHIND-THE-EAR HEARING AID

(76) Inventor: Theodore J. Marx, 1121 11th Ave., Fulton, IL (US) 61252

( * ) Notice: Subject to any disclaimer, the term of this patent is extended or adjusted under 35 U.S.C. 154(b) by 0 days.

(21) Appl. No.: 09/753,262

(22) Filed: Jan. 2, 2001

(65) Prior Publication Data

US 2002/0085729 A1 Jul. 4, 2002

(51) Int. Cl.[7] ..... H04R 25/00
(52) U.S. Cl. ..... 381/189; 381/359; 381/330
(58) Field of Search ..... 381/322, 330, 381/327, 325, 189, 359; 181/158, 166

(56) References Cited

U.S. PATENT DOCUMENTS 4,073,366 A * 2/1978 Estes ..... 181/158
4,443,667 A 4/1984 Hunt
4,489,330 A 12/1984 Marutake et al.
4,529,846 A 7/1985 Freeman et al.
5,249,234 A 9/1993 Butler
5,349,140 A 9/1994 Valenzin
5,524,056 A 6/1996 Killion et al.
5,981,020 A * 11/1999 Sutherland et al. ..... 428/85
6,101,258 A 8/2000 Killion et al.

* cited by examiner

*Primary Examiner*—Sinh Tran
(74) *Attorney, Agent, or Firm*—Husch & Eppenberger, LLC; Robert E. Muir; Richard J. Musgrave

(57) ABSTRACT

A support for a behind-the-ear hearing aid, including a body and a sound tube that includes at least one pad positioned underneath the behind-the-ear hearing aid, and at least one attachment mechanism that connects the at least one pad to the behind-the-ear hearing aid. This support device can also include a moisture guard that includes a sweat pad located underneath the body of the behind-the-ear hearing aid and also includes a muffler pad located adjacent to the microphone of the hearing aid and is attached to the sound tube of the behind-the-ear hearing aid wherein the at least one attachment mechanism further includes a first attachment mechanism to attach the sweat pad underneath the body of the behind-the-ear hearing aid and a second attachment mechanism to attach the muffler pad to the sound tube and adjacent to the microphone of the behind-the-ear hearing aid. The support and sweat pads can, but are not necessarily, made of foam. The optimal first attachment mechanism is made of VELCRO®, however, any of a wide variety of elastomeric bands may be used instead. The second attachment mechanism is in the form of sleeving or tubing with an optional slit down the longitudinal axis. The optimal material is polyethylene.

13 Claims, 3 Drawing Sheets

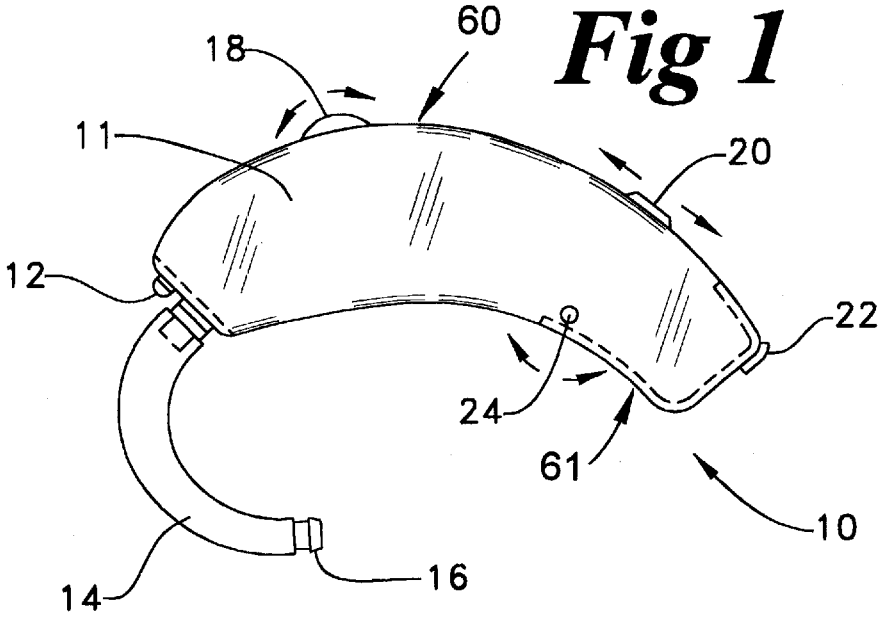
PRIOR ART
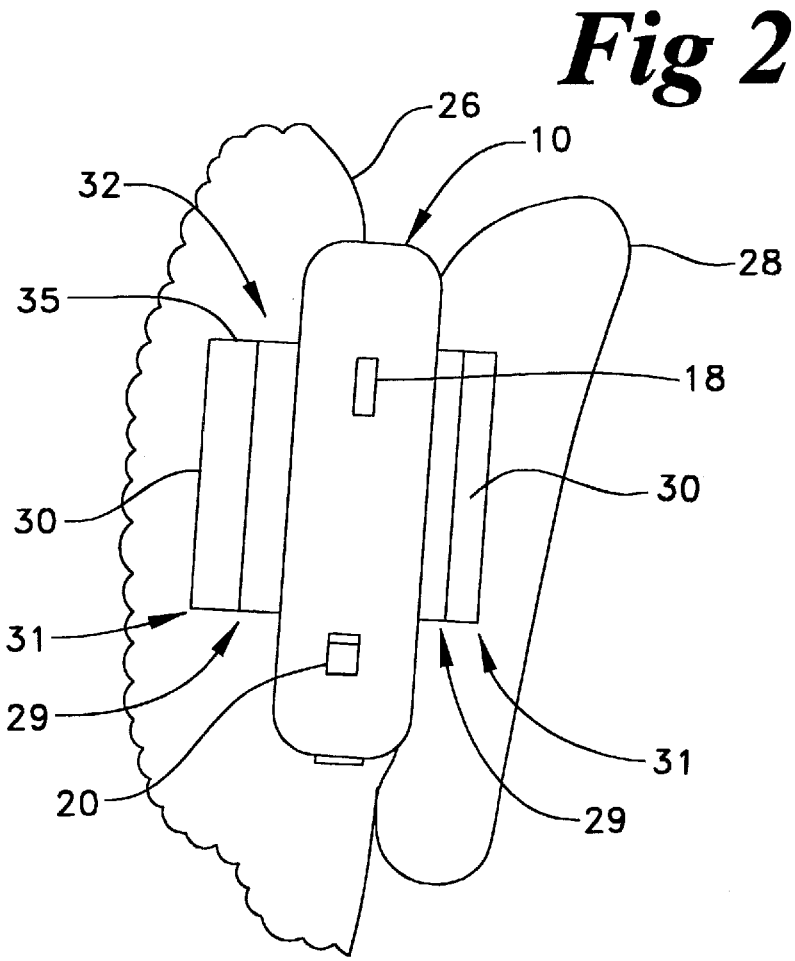

SUPPORT DEVICE FOR A BEHIND-THE-EAR HEARING AID

BACKGROUND OF THE INVENTION

It has been estimated that approximately eight percent (8%) of the population in the United States suffers from some degree of hearing loss. Many people who have a severe hearing loss use behind-the-ear hearing aids, also known as "BTE" hearing aids, since the smaller inner ear and ear canal types of hearing aids will not provide enough amplification. A BTE hearing aid is a combination of amplifier, microphone and control mechanism that is typically housed in an arcuate body and has a sound tube connected to the amplifier that transmits sounds directly into a person's ear. The BTE hearing aid is typically worn over the upper rear portion of a person's ear.

A significant problem with the BTE hearing aid is that moisture from a variety of sources including perspiration, humidity or precipitation can corrode the inner workings of the hearing aid and render the BTE hearing aid inoperable. This would then subject the BTE hearing aid to expensive repairs. This creates tremendous problems for a person with an active lifestyle who participates in sports or enjoys the outdoors. In addition, when being outside, the wind passing over the microphone of the BTE hearing aid creates unwanted noise and prevents people from hearing the sounds they desire to hear.

There are devices that completely engulf the BTE hearing aid with fluid impervious material to prevent corrosion from moisture such as that disclosed in U.S. Pat. No. 5,249,234, issued Sep. 28, 1993. Not only do these devices require time-consuming attachment and detachment from the BTE hearing aid, but these devices also do not provide any benefit regarding the extraneous sound generated by the wind with the microphone remaining exposed. Since they completely conform to the BTE hearing aid, these devices are expensive to manufacture and maintain. Furthermore, these devices make it difficult to change the battery, adjust the volume, and move the switch on the BTE hearing aid.

The present invention is directed to overcoming one or more of the problems set forth above.

SUMMARY OF THE INVENTION

In one aspect of this invention, a support for a behind-the-ear hearing aid, including a body and a microphone is disclosed. The support includes at least one pad positioned adjacent to the behind-the-ear hearing aid, and at least one attachment mechanism that connects the at least one pad to the behind-the-ear hearing aid.

In another aspect of this invention, a support for a behind-the-ear hearing aid, including a body, microphone and a sound tube is disclosed. The support includes a sweat pad located underneath the body of the behind-the-ear hearing aid, a muffler pad located adjacent the microphone of the behind-the-ear hearing aid and attached to the sound tube of the behind-the-ear hearing aid, a first attachment mechanism to attach the sweat pad underneath the body of the behind the-ear hearing aid, and a second attachment mechanism to attach the muffler pad to the sound tube of the behind-the-ear hearing aid.

BRIEF DESCRIPTION OF THE DRAWINGS

For a better understanding of the present invention, reference may be made to the accompanying drawings in which:

FIG. 1 is a side elevational view of a conventional behind-the-ear (BTE) hearing aid;

FIG. 2 is a front elevational view of a support device of the present invention utilized in conjunction with a behind-the-ear (BTE) hearing aid, which includes a sweat pad secured underneath the body of the BTE hearing aid with VELCRO®;

DETAILED DESCRIPTION OF THE INVENTION

In the following detailed description numerous, specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Figure 5:
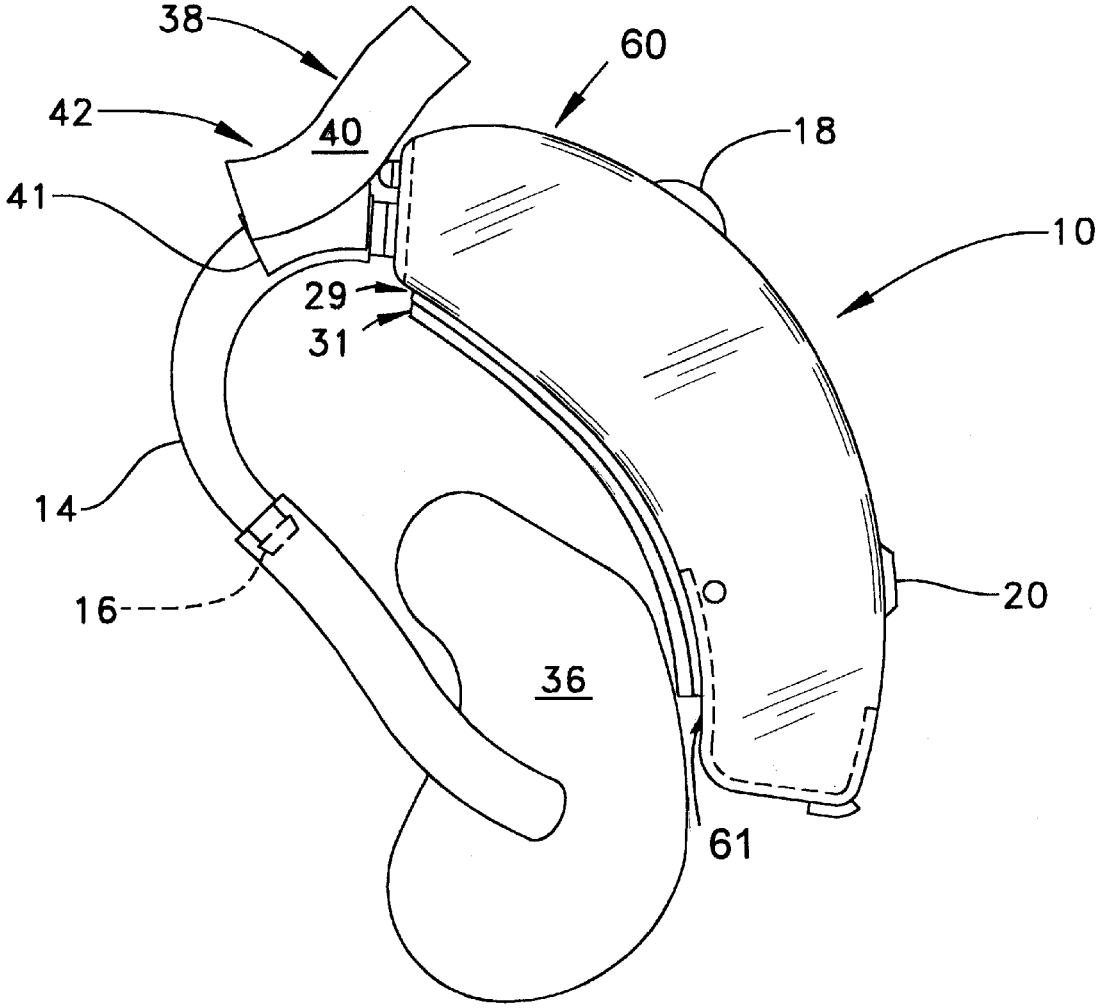
FIG. 5 is a side elevational view of a conventional behind-the-ear (BTE) hearing aid and the second component of the support device for the behind-the-ear (BTE) hearing aid, which includes the muffler pad and the second attachment mechanism shown in FIG. 4.

Referring now to the drawings, and initially to FIG. 1, a typical behind-the-ear "BTE" hearing aid is illustrated and generally indicated by numeral 10. This BTE hearing aid 10 has a body 11 that is generally curved in an arcuate manner and is typically worn on the upper rear portion of a person's ear. The body 11 of the BTE hearing aid 10 houses an electronic amplifier, battery, and filtering circuitry (not shown). The electronic amplifier is typically very sensitive. There is a microphone 12 that is located on the front portion of the BTE hearing aid 10 that picks up ambient sound waves and transmits them to the filtering and sensitive amplification circuitry (not shown) that is located in the body 11 of the BTE hearing aid 10. There is a telecoil (not shown) that is located internally within the BTE hearing aid 10. This technology is disclosed in U.S. Pat. No. 4,529,846, issued July 16, 1985, U.S. Pat. No. 4,443,667, issued Apr. 17, 1984, and U.S. Pat. No. 4,489,330, issued Dec. 18, 1984, which are all incorporated herein by reference. The telecoil is utilized by the person with the BTE hearing aid 10 when he or she is using the telephone. The filtered and amplified sound is then transmitted to the person's ear through a sound tube 14 (otherwise known as an ear tube) that has end portion 16 that is connected to a custom ear insert 36, as shown in FIG. 5. Although there are a number of miniature hearing aids that can be inserted directly in the ear and are barely detectable, these types of hearing aids do not work for people with a severe hearing loss. These include the inner ear and ear canal types of hearing aids.

The BTE hearing aid 10 typically, but not necessarily, includes a rotatable volume control wheel 18 and a switch 20 on a top 61 of the body 11 that can be operated by the person using the BTE hearing aid 10, as shown in FIG. 1. The switch 20 is a three-position switch that includes a position for "OFF", "MICROPHONE" and "TELECOIL", in that respective order. This allows the individual to switch between microphone usage to telecoil usage if the person is using the phone or turning the BTE hearing aid 10 off altogether. There is a battery compartment 22 that is hingedly mounted on pivot pin 24 to provide access to a small cylindrical zinc battery (not shown). Although the cylindrical zinc battery is preferred, any type of battery utilized with hearing aids will suffice. Some of these zinc batteries require exposure to air in order to complete the chemical reaction.

The support device is generally indicated by numeral 29, as shown in FIG. 2, includes two components. The first component 31 performs the function of a moisture guard includes a sweat pad 30, as shown in FIG. 2, that is positioned underneath 61 the body 11 of the BTE hearing aid 10 and is connect by a first attachment mechanism 32. The preferred type of first attachment mechanism 32 is VELCRO® 35. VELCRO® is a registered trademark of BVA Limited Liability Company of the Netherlands and located at Castorweg 22–24 Curacao, Antilles, Netherlands.

Figure 3:
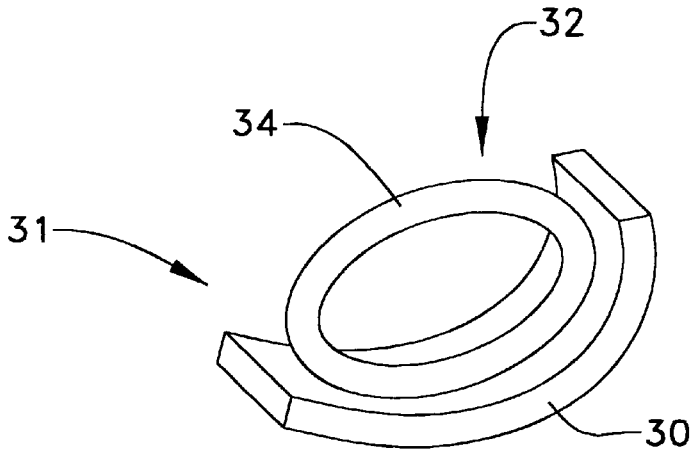
FIG. 3 is a perspective view of first component of the support device for the behind-the-ear (BTE) hearing aid, which includes a sweat pad and an alternative embodiment of the first attachment mechanism, which includes elastomeric material.

However, an alternative embodiment of the first attachment mechanism 32 would include the use of elastomeric material. There are numerous types of elastomeric material, including but not limited to: foam bands; a cotton, rubber and polyester combination, e.g. 93% cotton, 5% rubber and 3% polyester; sponge bands; rubber bands; and elastic bands. Another low cost alternative for the first attachment mechanism 32 is the use of pony tail bands 34, as shown in FIG. 3. In addition, although not elastomeric, a cotton and polyester combination, e.g. 97% cotton and 3% polyester can be utilized.

Referring again to FIG. 2, the sweat pad 30 rests underneath the BTE hearing aid 10, which is positioned on the rear portion of the human ear 28, and the human head 26.

The preferred material for the sweat pad 30 is polyester polyurethane, which is in the form of flexible foam with a medium density. However, a host of other materials will suffice including, but not limited to: expanded foam, e.g., wind screen of 25–30 pores per square inch; fabric mesh; wire mesh; and wire and fabric combination mesh that are typically utilized in winds of 12 miles per hour or less; fur; fur-like covering; sonic foam; polyolefin foam; polyether polyurethane that is flexible foam and open cell; rubber foam that is flexible and preferably one-fourth to one-half inch thick; custom foams such as melamine form that is basotect flexible (open cell) made from melamine resin; pieced flexible or molded foam that is cut or glued in a special shape; polyester family of organic polymers; reticulated foam; silicone foam; synthetic latex; latex foam; and cloth interfacing or similar material.

Although the optimal dimensions for the sweat pad 30 are 1 inch in length, 0.625 inches in width, and 0.25 inches in depth, the shape of the sweat pad 30 can vary tremendously, with the optimal shape conforming to the body 11 of the BTE hearing aid 10 with just enough depth to drain moisture away from the BTE hearing aid 10. The sweat pad 10 performs the crucial function of draining sweat and moisture away from the sensitive electronics of the BTE hearing aid 10 to keep it operational.

Figure 4:
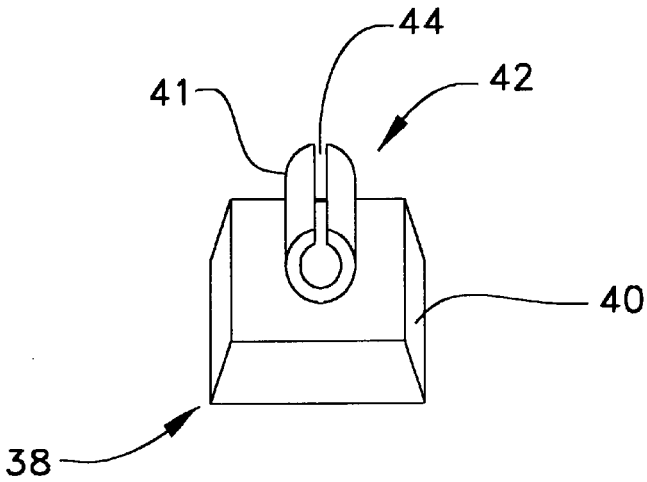
FIG. 4 is a perspective view of second component of the support device for the behind-the-ear (BTE) hearing aid, which includes a muffler pad and a second attachment mechanism.

The support device 29 also includes a second component, which performs a function of a wind muffler, and is generally indicated by numeral 38 in FIGS. 4 and 5. The second component 38 includes a muffler pad 40 that is connected to a second attachment mechanism 42.

This second attachment mechanism 42 performs the function of a clamp. The muffler pad 40, like the sweat pad 30, is preferably made of polyester polyurethane in the form of flexible foam with a medium density. However, a host of other materials will suffice including, but not limited to: expanded foam, e.g., wind screen of 25–30 attached underneath 61 of the body 11 pores per square inch; fabric mesh; wire mesh; and wire and fabric combination mesh that are typically utilized in winds of 12 miles per hour or less; fur; fur-like covering; sonic foam; polyolefin foam; polyether polyurethane that is flexible foam and open cell; rubber foam that is flexible and preferably one-fourth to one-half inch thick; custom foams such as melamine form that is basotect flexible (open cell) made from melamine resin; pieced flexible or molded foam that is cut or glued in a special shape; polyester family of organic polymers; reticulated foam; silicone foam; synthetic latex; latex foam; and cloth interfacing or similar material.

The optimal dimensions for the muffler pad 40 are 0.875 inches in length, 0.75 inches in width, and 0.25 inches in depth; however, any of a wide variety of dimensions will suffice to block the wind from the microphone 12.

The second attachment mechanism 42, as shown in FIGS. 4 and 5, is preferably in the form of tube or sleeve 41 having a slit 44 along the longitudinal axis of the tube 41. The slit 44 provides a tight fit or clamp around the sound tube 14. The preferred material for the sleeving or tubing material of the tube 41 is polyethylene. However, vinyl, polyvinyl chloride, polyolefin, polypropylene, ethylene corolmer, nylon, ethylene vinyl acetate "EVA", TYE and even an insulator found on a terminal clip will also suffice. Also, SURLYN®, NUCREL®, and ELRAX™ can be utilized and are manufactured by E. I. du Pont de Nemours and Company, which is a Delaware corporation, that is located at Market Street, Wilmington, Del. 19898.

The tube 41 can be attached to the muffler pad 40 by any of a wide variety of adhesives or mechanical connectors. The optimal dimensions for the tube 41 is 0.25 inches for the outer diameter and 0.17 inches for the inner diameter; however, a wide variety of dimensions will suffice. Although any color of tube 41 will suffice, the optimal color is milky-white for both cost and aesthetics.

By having the tube 41 attached or clamped to the sound tube 14 in a fixed position, it allows the muffler pad 40 to block the wind from hitting the microphone 12 and create extraneous noise. The tube 41 is attached to the muffler pad 40 with the muffler pad 40 in contact with the side of the human head 26, as shown in FIG. 2. This allows the hearing impaired to hear the desired sound and significantly reduces the noise generated due to the wind. It also allows the individual to adjust the volume control wheel 18 or the switch 20 on the top 60 of the body 11 without removing the support device 29 attached undertneath 61 of body 11, which provides a strong advantage over other protective devices for BTE hearing aids 10. Moreover, the small cylindrical zinc battery (not shown) can be easily removed by opening the battery compartment 22 that is hingedly mounted on pivot pin 24 without having to remove or alter the support device 29.

Industrial Applicability

The present invention is advantageously applicable in allowing the hearing impaired who require the use of a BTE hearing aid 10 to lead very active and productive lives without the problems created by moisture and wind that are necessarily present in most sports, including but not limited to jogging, biking, golfing, boating and so forth.

The following description is only for the purposes of illustration and is not intended to limit the present invention as such. It will be recognizable, by those skilled in the art, that the present invention is suitable for a plurality of other applications.

The support device 29 includes two main components of a moisture guard 31 and a wind muffler 38. The moisture guard 31 includes a sweat pad 30 that is attached to the body 11 of the BTE hearing aid 10 through a first attachment mechanism 32 and carries and diverts moisture away from the sensitive electronic circuitry of the BTE hearing aid 10 and thus prevents corrosion. There is no capillary action present such as that found in a sponge or cloth. The first attachment mechanism 32 is preferably VELCRO® 35; however, any of a wide variety of elastomeric and other materials will suffice.

The wind muffler 38 having a muffler pad 40 attached to a second attachment mechanism 42 that is secured to the sound tube 14 that prevents the wind from creating extraneous noise at the microphone 12. The second attachment mechanism 42 in the form of tube or sleeve 41 which attaches or clamps to the sound tube 14. wind does not directly hit the microphone 12 so that no adjustment to the rotatable volume control wheel 18 is needed for wind speeds up to 20 miles per hour. It is only after that point that some adjustment might be necessary. It is a distinct advantage of this invention to be able to adjust the rotatable volume control wheel 18 or the switch 20 without having to remove a protective covering of some type. This also applies to replacement of the battery in the battery compartment 22.

In view of the foregoing, it is readily apparent that the subject support device in a very simple and effective manner allows the use of the BTE hearing aid 10 under conditions where wind and moisture may be present. This allows the severely hearing impaired to have a very active lifestyle while still being able to hear the sounds around them.

Other aspects, objects and advantages of the present invention can be obtained from a study of the drawings, the disclosure and the appended claims.

What is claimed is:

1. A support for a behind-the-ear hearing aid, including a body, microphone and a sound tube, comprising:

a sweat pad located underneath said body of said behind-the-ear hearing aid;

a muffler pad located adjacent said microphone of said behind-the-ear hearing aid and attached to said sound tube of said behind-the-ear hearing aid;

a first attachment mechanism to attach said sweat pad underneath said body of said behind-the-ear hearing aid; and a second attachment mechanism to attach said muffler pad to said sound tube of said behind-the-ear hearing aid.

2. A support for a behind-the-ear hearing aid, including a body and a microphone and a sound tube, comprising:

at least one pad positioned adjacent to said behind-the-ear hearing aid;

at least one attachment mechanism that connects said at least one pad to said behind-the-ear hearing aid; and wherein said at least one pad positioned underneath said behind-the-ear hearing aid further includes a sweat pad located underneath said body of said behind-the-ear hearing aid and a muffler pad located adjacent said microphone and attached to said sound tube of said behind-the-ear hearing aid wherein said at least one attachment mechanism further includes a first attachment mechanism to attach said sweat pad underneath said body of said behind-the-ear hearing aid and a second attachment mechanism to attach said muffler pad to said sound tube of said behind-the-ear hearing aid.

3. The support for a behind-the-ear hearing aid, as set forth in claim 2, wherein said sweat pad includes polyester polyurethane.

4. The support for a behind-the-ear hearing aid, as set forth in claim 2, wherein said sweat pad is selected from the group consisting of expanded foam, polyether polyurethane, fabric, wire mesh, far, fur-like covering, sonic foam; polyolefin foam, rubber foam, melamine form, polyester foam, reticulated foam, silicone foam, synthetic latex, latex foam and cloth.

5. The support for a behind-the-ear hearing aid, as set forth in claim 2, wherein said muffler pad includes polyester polyurethane.

6. The support for a behind-the-ear hearing aid, as set forth in claim 2, wherein said muffler pad is selected from the group consisting of expanded foam, polyether polyurethane, fabric, wire mesh, fur, fur-like covering, sonic foam; polyolefin foam, rubber foam, melamine form, polyester foam, reticulated foam, silicone foam, synthetic latex, latex foam and cloth.

7. The support for a behind-the-ear hearing aid, as set forth in claim 2, wherein said first attachment mechanism includes VELCRO®.

8. The support for a behind-the-ear hearing aid, as set forth in claim 2, wherein said first attachment mechanism includes elastomeric material.

9. The support for a behind-the-ear hearing aid, as set forth in claim 8, wherein said elastomeric material is selected from the group consisting of rubber bands, elastic bands, foam bands, a cotton, rubber and polyester combination, pony tail wraps and sponge bands.

10. The support for a behind-the-ear hearing aid, as set forth in claim 2, wherein said second attachment mechanism includes a tube, having a longitudinal axis.

11. The support for a behind-the-ear hearing aid, as set forth in claim 10, wherein said tube has a slit along said longitudinal axis.

12. The support for a behind-the-ear hearing aid, as set forth in claim 10, wherein said tube includes polyethylene.

13. The support for a behind-the-ear hearing aid, as set forth in claim 12, wherein said tube is selected from the group consisting of vinyl, polyvinyl chloride, polyolefin, polypropylene, ethylene corolmer, nylon, ethylene vinyl acetate, TYE, SURLYN®, NUCREL®, and ELRAX™.

* * * * *